United States Patent [19]

Becker et al.

[11] Patent Number: 4,749,029

[45] Date of Patent: Jun. 7, 1988

[54] HEAT SHEILD ASSEMBLY, ESPECIALLY FOR STRUCTURAL PARTS OF GAS TURBINE SYSTEMS

[75] Inventors: Bernard Becker; Helmut Maghon; Wilhelm Schulten, all of Mülheim/Ruhr, Fed. Rep. of Germany

[73] Assignee: Kraftwerk Union Aktiengesellschaft, Mülheim/Ruhr, Fed. Rep. of Germany

[21] Appl. No.: 937,103

[22] Filed: Dec. 2, 1986

[30] Foreign Application Priority Data

Dec. 2, 1985 [DE] Fed. Rep. of Germany ..... 3542531
Jul. 14, 1986 [DE] Fed. Rep. of Germany ..... 3623744

[51] Int. Cl.[4] ..... B22D 15/00; F02C 1/00

[52] U.S. Cl. ..... 165/47; 165/169; 60/755; 60/757

[58] Field of Search ..... 60/757, 753, 752, 754, 60/755, 756, 758, 265, 261, 39.32; 165/47, 169, 109.1; 110/338

[56] References Cited

U.S. PATENT DOCUMENTS

| | | | |
|---|---|---|---|
| 2,919,549 | 1/1960 | Haworth et al. | 60/753 |
| 2,938,333 | 5/1960 | Wetzler . | |
| 4,071,194 | 1/1978 | Eckert et al. | 60/755 |
| 4,085,580 | 4/1978 | Slattery | 60/756 |
| 4,361,010 | 11/1982 | Tanrikut et al. | 60/757 |
| 4,422,300 | 12/1983 | Dierberger et al. | 60/757 |

FOREIGN PATENT DOCUMENTS

| | | |
|---|---|---|
| 1173734 | 1/1965 | Fed. Rep. of Germany . |
| 647302 | 12/1950 | United Kingdom . |
| 790292 | 2/1958 | United Kingdom . |
| 790293 | 2/1958 | United Kingdom . |
| 1038661 | 8/1966 | United Kingdom . |
| 1487064 | 9/1977 | United Kingdom . |
| 2075659 | 11/1981 | United Kingdom . |

*Primary Examiner*—Louis J. Casaregola
*Assistant Examiner*—Donald E. Stout
*Attorney, Agent, or Firm*—Herbert L. Lerner; Laurence A. Greenberg

[57] ABSTRACT

A heat shield assembly includes a supporting structure having an outer surface to be shielded from a hot fluid, the supporting structure having cooling fluid ducts formed therein; and an internal lining formed of heat-resistant material, the internal lining including mutually adjacent mushroom-shaped heat shield elements each having a cap portion in the form of a polygonal plate body having a central region, the plate bodies each covering a portion of the outer surface of the supporting structure and defining cooling fluid gaps therebetween, and a shaft portion thermally moveably anchoring the central region of the plate body to the supporting structure.

21 Claims, 4 Drawing Sheets

HEAT SHEILD ASSEMBLY, ESPECIALLY FOR STRUCTURAL PARTS OF GAS TURBINE SYSTEMS

The invention relates to a heat shield assembly, including a supporting structure, especially a hot-gas conduit wall in gas turbine assemblies and the like, which is to be shielded from a hot fluid and which has cooling fluid ducts formed therein, and an internal lining which is formed of heat-resistant material and which is assembled from heat shield elements covering the surface and disposed alongside one another, leaving cooling fluid gaps therebetween, the heat shield elements being anchored in a thermally moveable manner on the supporting structure.

A heat shield assembly of this type is known, for instance, for lining the inside wall of the combustion chamber of a gas turbine system, from German patent DE-PS No. 11 73 734. The heat shield elements therein are in the form of profiled stones, which are secured at a distance from one another on the combustion chamber wall by means of retaining clamps formed of austenitic material, defining cooling air gaps therebetween. The retaining clamps are in turn held by bolts which pass through the combustion chamber wall. The bolts are adjustably held in the combustion chamber wall by means of eccentric bushings, in order to enable adaptation of the fastening to the dimensions of the combustion chamber stones, which are not always the same.

It is accordingly an object of the invention to provide a heat shield assembly, especially for structural parts of gas turbine systems, which overcomes the hereinaforementioned disadvantages of the heretofore-known devices of this general type and which is suitable for lining complexly shaped structures. The consumption of cooling air is intended to be as low as possible and to be distributed as uniformly as possible over the surface to be shielded, without permitting severe thermal stresses to arise at the heat shield elements and their fastenings. The heat shield assembly should only be formed of metal structural parts, if at all possible.

With the foregoing and other objects in view there is provided, in accordance with the invention, a heat shield assembly, comprising a supporting structure having an outer surface to be shielded from a hot fluid, the supporting structure having cooling fluid ducts formed therein; and an internal lining formed of heat-resistant material, the internal lining including mutually adjacent mushroom-shaped heat shield elements each having a cap portion in the form of a flat or three-dimentional polygonal plate body having straight or curved peripheral outlines and a central region, the plate bodies each covering a portion of the outer surface of the supporting structure and defining cooling fluid gaps therebetween, and a shaft portion thermally moveably anchoring the central region of the plate body to the supporting structure.

As will be explained in greater detail in conjunction with the drawings, the invention has various advantages. By constructing a single heat shield element in the shape of a mushroom, its cap portions can expand freely in all directions away from the shaft portion, without producing considerable thermal stresses. Optionally, the cap portions may expand more severely at the hot surface than at the lower surface thereof. Although this causes a slight curvature of the cap portions, it does not cause thermal stresses. Furthermore, it is possible to line any arbitrary three-dimensional surfaces of supporting structures with such heat shield elements without difficulty. Such surfaces can always be broken down into segments of suitable size, and it depends on the special shape whether the most favorable constructure will use triangles, polygons, or segments of the surface of a solid generated by rotation. It is also possible in principle to use cap portions that are curved in three dimensions. However, it is particularly advantageous, when possible, to approximate given structural surfaces by means of flat triangles, the size of the triangles depending on the desired accuracy of the approximation. Preferably, all of the angles of the triangles should be larger than 40 degrees and if at all possible, larger than 50 degrees. The resultant triangles are generally not equilateral, nor are they entirely identical to one another; however, it is desirable to use equilateral triangles if possible. This may cause difficulties at individual locations, but in principle it is desirable to use triangles which do not have overly acute angles, because otherwise the long points could have an increased tendency to oscillate. Although the individual heat shield elements do not absolutely have to be anchored exactly at their center of gravity, this is still the most favorable construction in general. The type of fastening depends on given requirements, so that structures with varying complexity are possible. The most simple structure is fastening with a tie bolt, which passes through the supporting structure in a through bore and is clamped against the supporting structure with at least one fastening nut secured to its free end. The tie bolts and the cap portions are preferably formed of steel. The shaft and cap portions are integral or "grown together", so to speak to form the tie bolts. By suitable means, such as a spacer ring or an annular shoulder, a defined distance between the supporting structure and the cap portion is established. However, a configuration of this kind can only be disassembled if the rear side of the supporting structure is accessible, which is not always possible, such as in the case of hot gas conduits in gas turbines. Another fastening type, as will be explained in greater detail in conjunction with the drawings, provides that the heat shield elements are screwed firmly from the hot-gas side by means of countersunk tie bolts having heads which are preferably flush with the surface of the cap portion; naturally, this requires suitably secured nuts on the rear side of the supporting structure, which may be welded on.

The decisive action of the heat shield assembly is attained by virtue of the manner of cooling the heat shield elements. A cooling fluid, preferably air, is carried through a great number of bores in the structure toward the lower surface of the cap portions. This air meets the surface that is to be cooled virtually at a right angle and flows away along it toward the sides (so-called impact cooling). This effect already cools the cap portions quite considerably. Furthermore, the cooling fluid flows to the edges of the cap portions and on through the gaps between the cap portions and is therefore diverted by the hot fluid flowing by, additionally forming a cooling film on the upper surface of the cap portions. Since most of the gaps do not extend in the flow direction, a very uniform, effective cooling film can be formed. Additional outlets cool the shaft portions, especially the heads thereof.

Since the cooling fluid gaps between the heat shield elements have different and changing widths in accordance with the temperature and other parameters, these gaps are only limitedly suitable as a defined throttle restriction for the cooling fluid flow. It is therefore advantageous to place base rails, skirting boards, projections or ridges on the supporting structure facing the gaps, which form a defined spacing relative to the cap portions. The base rails may also have defined indentations on the upper surface thereof, transverse to the course of the base rails, which also assure a minimum cooling fluid flow when the heat shield elements are resting on top. It may even be advantageous to dimension the ridges and heat shield elements in such a way that upon initial assembly they rest on top of one another and that a gap may perhaps form, in response to thermal influences, only after the apparatus has been put into operation. Special forms of the base rails such as annular or double base rails are used, for instance, at corners of a plurality of mutually adjacent heat shield elements.

Other features which are considered as characteristic for the invention are set forth in the appended claims.

Although the invention is illustrated and described herein as embodied in a heat shield assembly, especially for structural parts of gas turbine systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
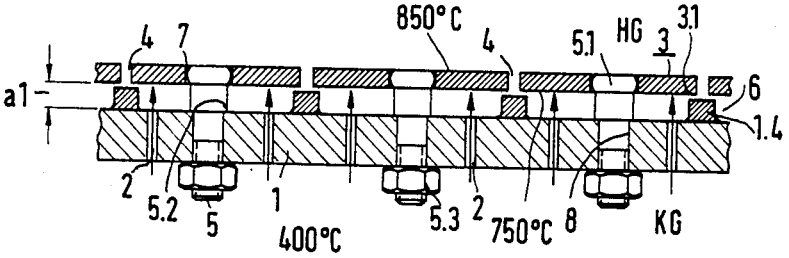
FIG. 2 is a fragmentary, simplified, cross-sectional view of the assembly taken along the line II—II in FIG. 1, in the direction of the arrows.
Figure 1:
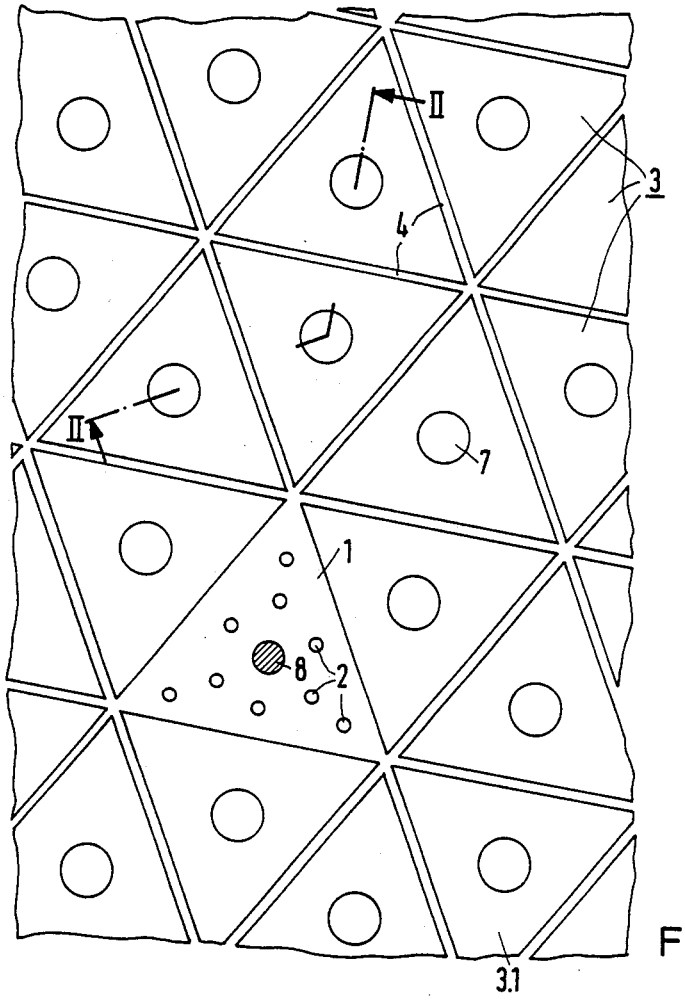
FIG. 1 is a fragmentary, diagrammatic, top-plan view of a heat shield assembly according to the invention.
Figure 6:
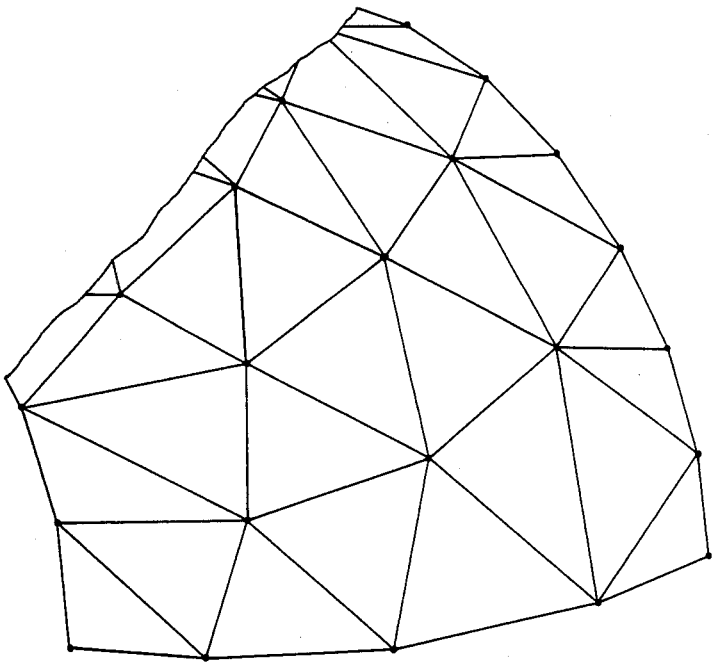
FIG. 6 is a fragmentary, perspective view of an embodiment of a supporting structure subdivided into triangles, namely a portion of a hot-gas conduit of a gas turbine.
Figure 7:
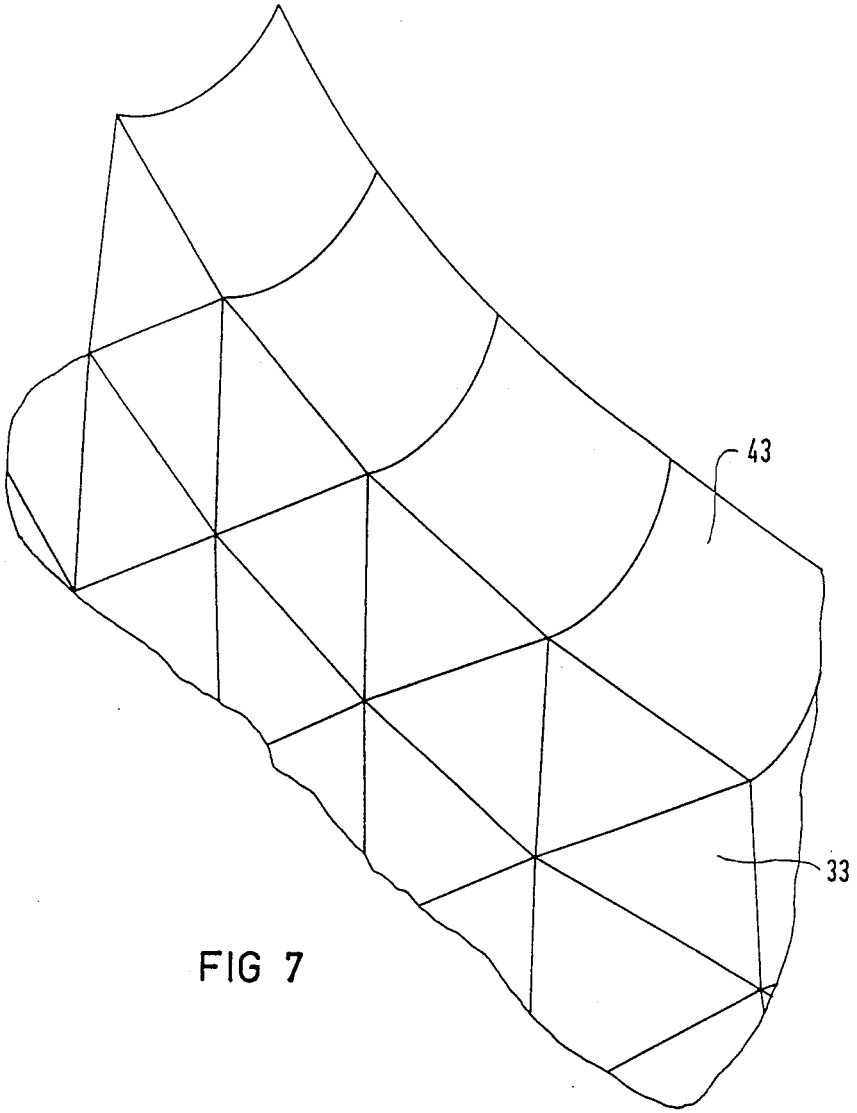
FIG. 7 is a view similar to FIG. 6 showing cap portions with the shape of a segment of a solid generated by rotation.

Referring now to the figures of the drawings in detail and first, particularly, to FIGS. 1 and 2 thereof, there is seen a diagrammatic and simplified heat shield assembly which is suitable in particular for gas turbine systems, and above all for the inside housing of the turbine, through which hot gases coming from the combustion chamber flow. It has heretofore been difficult to cool such supporting structures 1, or to shield them with heat shield assemblies. Such supporting structures were therefore usually used without heat shields, while making allowances for the disadvantages involved. According to the present invention, the supporting structure 1 is provided with cooling air ducts or openings 2, which are distributed uniformly or in accordance with the need for cooling, over the supporting structure 1. In order to illustrate the configuration of cooling air ducts 2 more clearly, one heat shield element has been omitted in FIG. 1, so that details of the structure located below it will be visible. Reference symbol HG represents the hot-gas side and reference symbol KG represents the cold-gas side; cooling air at overpressure is pushed from the cold-gas side through the ducts 2, as indicated by arrows. Heat shield elements having a cap portion 3 and a shaft portion 5 in the form of a mushroom, are anchored to the supporting structure 1. In the illustrated embodiment, the shaft portion is formed of a tie bolt 5, which passes through a through bore 8 in the supporting structure 1. The tie bolt 5 is spaced apart by a distance al from the hot-gas side HG of the supporting structure 1 by means of an annular shoulder 5.2 on a reinforced head 5.1 of the tie bolt, and the tie bolt is clamped against the supporting structure 1 by a fastening nut 5.3 screwed onto the free end of the tie bolt; the fastening nuts are also connected at the cold-gas side KG of the supporting structure 1 in a non-twisting manner by means of a non-illustrated spot weld. The cooling air flowing through the cooling air ducts 2 enters an interspace 6 between the supporting structure and the cap portion, strikes the lower surface 3.1 of the cap portion 3 and then flows along the lower surface 3.1 to cooling air gaps 4 between the individual cap portions 3. Base rails, skirting boards, projections or ridges 1.4 in the interspace 6 below the cooling air gaps 4 provide defined throttle restrictions and prevent the entry of hot-gas into the interspace 6. The cooling air emerging from the cooling air gaps 4 is diverted on the hot-gas side HG by the gas flow prevailing there and thus forms a film of cooling air on the surface of the cap portions 3, as a result of which an additional cooling effect takes place. The cap portions 3 of the individual heat shield elements and their tie bolts 5 are preferably both made of highly heat-resistant steel, so that they can be welded to one another without difficulty. Accordingly, the tie bolts 5 are each welded to the central portion at reference numeral 7. In order to illustrate the principle of the invention in a simplified form, in the illustrated embodiment it is first assumed that the heat shield elements have identical cap portions, taking the form of equilateral triangles. In the general case, as shown in FIG. 6, an irregularly curved surface formed of different polygons, preferably triangles, must be assembled. Although such polygons or triangles always have an accurately definable center of gravity, nevertheless the tie bolts need not absolutely be secured precisely at the center of gravity. Although in general this is advantageous, nevertheless it may be advantageous due to a tendency toward oscillation, to anchor some sections of the polygons outside the center of gravity.

In any case, the existence of only one anchoring point for each heat shield element has the advantage of ensuring that thermal expansions of the heat shield elements are unhindered, therefore preventing maximal thermal stresses from occurring.

Since, for example, an average temperature of approximately 400 degrees C. prevails during operation at the cold-gas side KG, and an average temperature of for instance 750 degrees C. prevails at the lower surface 3.1 of the cap portions 3, differential expansions arise between the supporting structure and the heat shield elements. However, such expansions are not hindered since the cap portions 3 are capable of expanding freely to all sides, as are the bolt heads 5.1. The tie bolts 5 are screwed firmly with initial tension, so that even upon heating to the operating temperature, it need not be feared that they may loosen. The cap portions themselves, which may have a higher temperature on the hot-gas side than on the lower surface 3.1 thereof, are also not hindered in their thermal expansion. They may optionally assume a convex curvature as viewed from the hot-gas side HG, which is possible without hindrance. The base rails or skirting boards 1.4 provide defined throttle restrictions for the cooling gas, which automatically adjust to uniform cross sections, as explained above. The precise width of the cooling air gaps 4 between the cap portions 3 is therefore not critical, as long as they are sufficiently wide. This is also advantageous, because under varying operating conditions these gaps change continuously.

Figure 3:
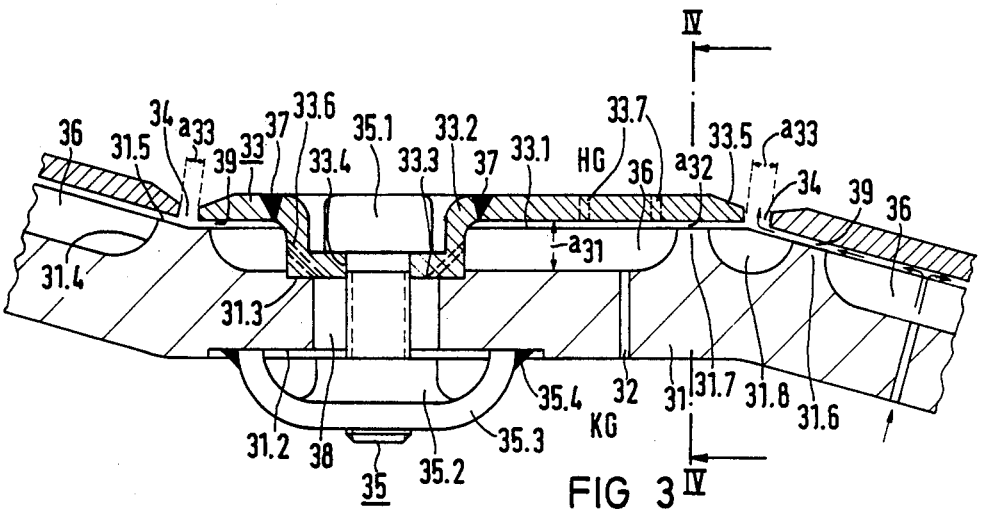
FIG. 3 is an enlarged, fragmentary, longitudinal-sectional view of a special preferred embodiment of the invention having countersunk tie bolts.
Figure 4:
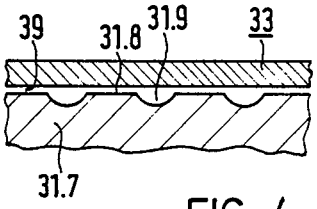
FIG. 4 is another fragmentary, sectional view taken along the line IV—IV in FIG. 3, in the direction of the arrows.
Figure 5:
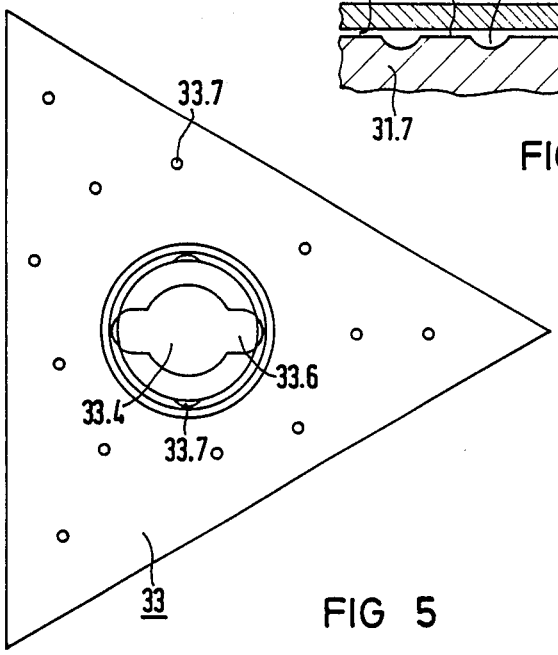
FIG. 5 is a top-plan view of a heat shield element of FIG. 4.

FIGS. 3, 4 and 5 illustrate another preferred embodiment of the invention. The cooling principle remains the same; only the fastening of the individual heat shield elements has been changed. Furthermore, this embodiment shows the disposition of heat shield elements on an uneven supporting structure. FIG. 3 is a longitudinal section taken through a portion of the heat shield assembly; FIG. 4 is a section taken through FIG. 3 along the line IV—IV; and FIG. 5 is a view from above upon a shield element. A supporting structure 31 again has cooling air or fluid bores 32, as well as firmly anchored heat shield elements having triangular cap portions 33. Cooling air gaps 34 having a width a33 are formed between the individual cap portions 33. An interspace 36 having a width a31 is formed between the supporting structure 31 and the lower surface 33.1 of the cap portions 33. The cap portions 33 have a cup-shaped embossment or recess 33.2, 33.3 in the central portion thereof and a through bore 33.4 in the lower surface 33.3 thereof. A bolt 35 passes through the bore 33.4 as well as through a corresponding through bore 38 in the supporting structure 31 and has a bolt head 35.1 located in the cup-shaped embossment or recess 33.2, 33.3, preferably flush with the surface of the cap portion 33 on the hot-gas side HG. On the hot-gas side HG the cap portions 33 have chamfered edges 33.5. The bolt head 35.1 may, for instance, have a hexagon socket or some similar access for a tool for tightening the bolt. The bolt is clamped by means of a nut 35.2 against the cold-gas side KG of the supporting structure 31, the nut having claw-like arms or protections 35.3, which are supported on the supporting structure 31 and are welded thereto at reference numeral 35.4. The nut 35.2 itself need not touch the supporting structure 31, since a suitable pretensioning can be attained by means of the claw-like arms 35.3. Furthermore, if the through bore 38 in the supporting structure 31 and the corresponding bore 33.4 are noticeably wider than the diameter of the bore 35, at least in some areas, cooling air can flow along the bolt 35 and thus cool it and above all its head 35.1. Suitable outflow conduits 33.6 must be provided in the cup-shaped embossment or recess 33.2, 33.3. Other provisions for maintaining the pretensioning force of the bolt 35 are possible, such as expansion screws, spring plates and the like. In order to assure accurate positioning of the heat shield elements, it is advantageous if the cup-shaped embossment or recess 33.2, 33.3 is supported against the supporting structure 31 in a form-locking groove 31.3. A form-locking connection is one in which elements are locked together by virtue of their shapes, as opposed to a force-locking connection requiring outside force. Additional cooling fluid openings, such as in the form of bores 33.6, may be provided in the cup-shaped embossment or recess 33.2, 33.3. Additional cooling fluid openings 33.7 can also be provided on portions of the heat shield elements 33 that need particular cooling, but these openings should not be in alignment with the cooling air or fluid bores 32. FIG. 3 also shows practical configurations of base rails or skirting boards or ridges 31.4, 31.6, 31.7 forming throttle restrictions 39 for the flow of cooling gas. These base rails or skirting boards may be taken into consideration from the outset when the supporting structure 31 is formed, such as by casting, or they may be applied later. As shown at the base rails or skirting boards or ridges 31.4, they should have a surface shape 31.5 adapted to the course of the adjoining cap portions 33, although this is not absolutely necessary if only one defined throttle restriction s formed. Difficulties can arise in the disposition of the base rails or skirting boards in the vicinity of the points of contact of a plurality of heat shield elements, because of excessive accumulations of material. In such a location, it is also possible for the base rails or skirting boards to have special shapes as needed, such as that shown for the base rails or skirting boards 31.6, 31.7 which have an annular course that may have a hemispherical recess 31.8 in the interior. Thus, defined throttle restrictions 39 spaced apart by a suitable distance a32 remain, without excessive amounts of material being accumulated at one point.

As indicated in FIG. 4, it may be advantageous to provide indentations 31.9 in the upper surface 31.8 of the base rails or skirting boards 31.7, extending transverse to the course of the base rails or skirting boards, thereby assuring a minimum flow of cooling fluid even when the heat shield elements 33 are stacked on top. Such indentations can also be introduced into the lower surface of the cap portions 33.

Finally, FIG. 6 shows an embodiment of the subdivision of a curved surface into suitable triangles. For instance, an inside housing of a gas turbine can be approximated quite well using relatively few triangles, without the individual heat shield elements having to be curved. A better approximation of the shape is possible in principle either by using a larger number of polygons, for instance triangles, or by using curved heat shield elements. A considerable advantage in the use of triangles, however, is that three points always define one plane, so that the subdivision of a curved surface into triangles presents the least problems in later manufacture of the heat shield elements.

FIG. 6 shows cap portions with the shape of a segment of a solid generated by rotation.

The present invention is suitable in particular for hot-gas conduits, combustion chambers and similar parts of gas turbines, but is not restricted to such applications. The heat shield assembly enables the use of higher temperatures in the interior of a supporting structure, simplifies its construction and lessens the strains thereon.

We claim:

1. Heat shield assembly, comprising:

a supporting structure having an outer surface to be shielded from a hot fluid, said supporting structure having cooling fluid ducts formed therein;

an internal lining formed of heat-resistant material, said internal lining including:

mutually adjacent mushroom-shaped heat shield elements each having a cap portion in the form of a polygonal plate body having a central region, said plate bodies each covering a portion of said outer surface of said supporting structure and defining cooling fluid gaps therebetween, each of said cooling fluid gaps having a given length and extend in a given direction, and a shaft portion thermally moveably anchoring said central region of said plate body to said supporting structure; and said supporting structure having base rails disposed thereon opposite each of said cooling fluid gaps extending in said given direction and over substantially said given length defining a spacing between said base rails and said cap portions forming a defined throttle restriction for a cooling fluid flow.

2. Heat shield assembly according to claim 1, wherein each of said polygonal plate bodies is flat or three-dimensional and has straight or curved peripheral edges.

3. Heat shield assembly according to claim 1, wherein said cap portions each have a triangular outline.

4. Heat shield assembly according to claim 1, wherein said cap portions each have substantially the shape of a segment of a surface of a solid generated by rotation.

5. Heat shield assembly according to claim 1, wherein said shaft portions and said cap portions together form integral tie bolts having free ends passing through bores formed in said supporting structure, and including at least one fastening nut screwed on each of said free ends and clamped against said supporting structure, said tie bolts each having an annular shoulder maintaining an interspace between said cap portions and said supporting structure.

6. Heat shield assembly according to claim 1, wherein:

a. each of said cap portions has a cup-shaped embossment formed in said central portion thereof protruding toward said supporting structure and defining a lower surface of said embossment having a first bore formed therein;

b. said cup-shaped embossments being supported on said supporting structure defining a spacing between said cap portions and said supporting structure;

c. and including a screw connection having bolts each passing through one of said first bores and through one of second bores formed in said supporting structure, and nuts supported against said supporting structure and clamping said cap portions on said supporting structure, said bolts having heads countersunk in said cup-shaped embossments.

7. Heat shield assembly according to claim 6, wherein said nuts have claw-like arms or projections supported on said supporting structure.

8. Heat shield assembly according to claim 7, wherein said arms are connected to said supporting structure.

9. Heat shield assembly according to claim 5, wherein at least said cap portions and said tie bolts are formed of highly thermal-resistant materials.

10. Heat shield assembly according to claim 5, wherein said ducts formed in said supporting structure are disposed at right angles to said portions for conducting a cooling fluid flow into said interspace.

11. Heat shield assembly according to claim 1, wherein said base rails have an upper surface and said cap portions have a lower surface, at least one of said upper and lower surfaces being structured for ensuring a minimum cooling fluid flow even when said cap portions rest on said base rails.

12. Heat shield assembly according to claim 11, wherein said upper surfaces have shapes adapted to the shape and the direction of the adjoining cap portions.

13. Heat shield assembly according to claim 12, wherein said base rails are double and have a center groove for avoiding excessive accumulations of material.

14. Heat shield assembly according to claim 1, wherein said cap portions have chamfered edges on the hot-gas side.

15. Heat shield assembly according to claim 1, wherein at least one of said supporting structure and said cap portions have additional outlet paths formed therein for cooling fluid in the vicinity of said shaft portions for cooling said shaft portions.

16. Heat shield assembly according to claim 6, wherein at least one of said cap portions and said supporting structure have additional recesses adjoining said bores enabling a flow of cooling fluid along said shaft portions.

17. Heat shield assembly according to claim 1, wherein said cap portions have additional cooling fluid outlets formed therein.

18. Heat shield assembly according to claim 12, wherein each of said shaft portions is anchored to said supporting structure at a given point of contact, and said base rails are annular in the vicinity of said given points of contact of a plurality of heat shield elements for avoiding excessive accumulation of material.

19. Heat shield assembly according to claim 13, wherein each of said shaft portions is anchored to said supporting structure at a given point of contact, and said base rails are annular in the vicinity of said given points of contact of a plurality of heat shield elements for avoiding excessive accumulation of material.

20. Heat shield assmebly according to claim 18, wherein said arms are connected to said supporting structure.

21. Heat shield assembly, comprising:

a supporting structure having an outer surface to be shielded from a hot fluid, said supporting structure having cooling fluid ducts therein;

an internal lining formed of heat-resistant material, said internal lining including:

mutually adjacent heat shield elements each having the shape of a polygonal plate body, said plate bodies each covering a portion of said outer surfaces of said supporting structure and defining cooling fluid gaps therebetween;

means for maintaining an interspace between said heat shield elements and said supporting structure; and a screw connection for anchoring said heat shield elements to said supporting structure, said screw connection having bolts each passing through bores formed in said supporting structure, and nuts supported against said supporting structure, said nuts having claw-like arms .or projections supported on said supporting structure.

* * * * *